United States Patent [19]

Hirasawa et al.

[11] 4,046,650

[45] Sept. 6, 1977

[54] CARBON BLOCK FOR CATHODES OF ALUMINUM

[75] Inventors: Kazuhiko Hirasawa, Nagoya; Yasuo Okamoto, Okayama, both of Japan

[73] Assignees: Sumitomo Aluminum Smelting Co., Ltd.; Kyowa Carbon Company, Limited, both of Osaka, Japan

[21] Appl. No.: 572,767

[22] Filed: Apr. 29, 1975

Related U.S. Application Data

[63] Continuation of Ser. No. 123,469, April 29, 1975, abandoned.

[30] Foreign Application Priority Data

Mar. 16, 1970 Japan ..... 45-22397

[51] Int. Cl.[2] ..... C25C 1/02; C25C 7/02

[52] U.S. Cl. ..... 204/67; 204/294

[58] Field of Search ..... 204/67, 294

[56] References Cited

U.S. PATENT DOCUMENTS

| | | | |
|---|---|---|---|
| 2,527,596 | 10/1950 | Shea et al. | 204/294 |
| 2,582,764 | 1/1952 | Bailey | 204/294 |
| 3,400,061 | 9/1968 | Lewis et al. | 204/294 |
| 3,506,745 | 4/1970 | Juel et al. | 264/29 |

*Primary Examiner*—F.C. Edmundson

*Attorney, Agent, or Firm*—Sughrue, Rothwell, Mion, Zinn and Macpeak

[57] ABSTRACT

A carbon block for a cathode of an aluminum electrolytic cell comprising a carbon block having a stability constant of 0.7–1.0, said block composed of a baked raw material mainly comprising petroleum coke. The block is prepared by baking a carbon block mainly comprising petroleum coke at high temperatures.

2 Claims, No Drawings

CARBON BLOCK FOR CATHODES OF ALUMINUM

This is a continuation of application Ser. No. 123,469, filed Apr. 29, 1975, now abandoned.

BACKGROUND OF THE INVENTION

1. Field of the Invention

The present invention relates to a cathode carbon block for an aluminum electrolytic cell prepared by baking raw materials mainly comprising petroleum coke at a high temperature and more particularly, the invention relates to a cathode carbon block for an aluminum electrolytic cell having a stability constant of 0.7–1.0 and capable of continuing electrolysis over a long period of time.

2. Description of Prior Art

A carbon cathode for an aluminum electrolytic cell is constructed by lining carbon blocks baked preliminarily on the bottom of an electrolytic cell. As is well known, the electrolytic production of aluminum is generally carried out by dissolving alumina in a molten salt bath mainly composed of cryolite at about 940° C in an electrolytic cell and passing a DC current through the electrolytic cell.

Because the carbon cathode is subjected to such severe conditions such as the passage of electric current, the high temperature and contact with a molten salt and molten aluminum at the bottom of the cell, the carbon cathode is gradually deteriorated. The deterioration of the carbon cathode is also caused by the penetration of the molten salt bath as well as by the violent attack of the initial current passing through and thermal shock. The deterioration of the carbon cathode is accompanied by certain defects which prove unprofitable in operation and economy, such as the increase in electric resistance, the unevenness in electric current distribution, and the reduction in current efficiency.

A carbon block for a cathode of an aluminum electrolytic cell is usually produced by calcining a raw material mainly comprising anthracite at about 1300° C. Recently, the use of a carbon cathode having graphite compounded therein has been attempted. Although the swelling property of the cathode by the penetration of sodium in a molten salt bath may be improved by the addition of graphite, the remarkable effect of greatly prolonging the life of the cell cannot be obtained by using such cathode carbon block.

Although the characteristics of the cathode carbon block give decisive influences on the life of the electrolytic cell, the characteristics of the cathode desired are ambiguous and the main factors for producing the carbon cathode satisfying the aforesaid purposes are also obscure. Illustrative of such characteristics desired for the carbon cathode for an aluminum electrolytic cell are a fine structure, less microporosity, a high spalling resistance, favorable mechanical properties, a low specific resistance, and a high chemical stability. In general, it has been determined that the carbon cathode has an apparent specific gravity of higher than 1.55, a true specific gravity of higher than 1.90, a porosity of less than 20%, a specific resistance of less than $500 \times 10^{-5}$ ohm-cm, a compressive stength of higher than 300 kg/cm$^2$, and a tensile strength of higher than 20 kg/cm$^2$. However, even in the case of using a carbon cathode satisfying these standard factors, the life of the aluminum electrolytic cell can be increased to only about four years on the average.

SUMMARY OF THE INVENTION

It is therefore the primary object of this invention to provide a carbon block for cathodes of an aluminum electrolytic cell which overcomes those disadvantages discussed above relative to the prior art.

Thus, as a result of several years of investigating the relations of the various properties of carbon cathodes and the life of the aluminum electrolytic cell, the present inventors have discovered that the carbon block prepared by baking a carbon block formed by compounding a raw material mainly comprising petroleum coke at a high temperature and having a stability constant of 0.7–1.0 gives particularly excellent results when used in an aluminum electrolytic cell.

The use of the stability constant is a well known feature to show the ratio of the amount of a molten electrolytic bath penetrating into the porosity of the carbon cathode. The stability constant of a carbon cathode is measured as follows: that is, 400 g of cryolite ($NaF/AlF_3 = 2.5$), 40 g of alumina, 52 g of potassium hydroxide, and 50 g of aluminum are melted in a graphite crucible of 100–120 mm in height and 70–80 mm in inside diameter as a small electrolytic cell at 950°–980° C. A sample carbon cathode of 120 mm in length and 35 mm in diameter is immersed in the molten mixture until a half lower part thereof is under the level of the molten bath and a DC current of 0.7 amp/cm$^2$ in current density per the immersed area of the sample is passed through the crucible as an anode and the sample (as a carbon cathode) and the electrolysis is conducted for 2 hours. After the electrolysis is finished, the aluminum is removed from the surface of the sample and the lower part of 50 mm in length is cut from the sample. When the amount of the electrolytic bath penetrating into the cut portion is designated to be $\Delta P\%$ (by weight), the apparent specific gravity of the sample $d_1$, the specific gravity of the electrolytic salt bath $d_2$, and the porosity of the sample P%, the stability constant $K_b$ is calculated by the following equation (1).

$$K_b = \frac{\Delta P \times d_1}{d_2 \times P} \quad (1)$$

If the stability constant is large, the carbon cathode is less stable to the molten salt electrolyte. That is, when such a carbon cathode is used, sodium in the molten salt bath penetrates into the cathode carbon to cause a swelling phenomenon and thus the cathode is bent or expands in addition to the surface portion of the cathode being stripped away. In general, the stability constant becomes smaller as the extent of baking of the carbon cathode becomes larger. Therefore, as far as the decision by the stability constant is concerned, a carbon cathode that has been baked more sufficiently is considered to have a higher stability to the molten salt. However, on the other hand, it has been considered that as the progress of graphitization by baking, aluminum carbide tends to form on the surface of the carbon cathode at the aluminum electrolytic production, which increases the electric resistance of the carbon cathode and reduces the efficiency of the electrolysis. Furthermore, as the graphitization progresses, the mechanical strengths such as the compressive strength and bending strength of the carbon cathode are reduced also. Thus, on considering wholly the aforesaid factors, it has been believed that the proper stability constant should be 1.0–1.5.

DETAILED DESCRIPTION OF THE INVENTION

According to the present invention, there is provided a carbon block for a cathode of an aluminum electrolytic cell prepared by graphitizing a carbon block mainly composed of petroleum coke and having a stability constant of 0.7–1.0. The specific resistance of the carbon cathode of this invention prepared by using petroleum coke as the main raw material is about ¼ lower than the general standard value, but the mechanical strength thereof is about 20–30% lower than the lower limit of the standard value. Moreover, the porosity of the carbon cathode is about 1.5 times as much as the upper limit of the standard value. Thus, although the properties of the carbon cathode prepared by baking petroleum coke at a high temperature do not satisfy the general standard values in the mechanical properties and porosity, the use of the carbon cathode can prolong the average cell life more than one year as compared with the case of using conventional carbon cathodes. On the other hand, when known carbon cathode prepared by graphitizing calcined anthracite is used, the specific resistance may be reduced but at the same time the mechanical strength is reduced to less than ¼ of the standard value, which results in reducing the life of the electrolytic cell.

The baking temperature for preparing the carbon block of this invention is higher than 2000° C. That is, the carbon block baked at temperatures of higher than 2000° C is hardly swelled by the molten bath composition for an aluminum electrolytic cell. A carbon block baked at temperatures of lower than 2000° C has a large swelling property and when such a carbon block is used as a cathode for an aluminum electrolytic cell, the cathode is readily swelled by the molten salt electrolyte during electrolysis.

As mentioned above, the carbon cathode of this invention has a stability constant of 0.7–1.0 and in such case the average life of an electrolytic cell is improved. On the other hand, if a carbon cathode having a stability constant outside the range of 0.7–1.0 is used, the average cell life is less than four years. The reasons why the carbon cathode having the stability constant of 0.7–1.0 gives good results when it is used for aluminum electrolytic cell (although the carbon cathode does not satisfy the general standard values as the cathode) have not yet been ascertained, but by the results of the overhaul of the electrolytic cell removed from the circuit for repair, considerable bending, swelling and surface stripping of the carbon cathode used for the electrolytic cell were observed when the stability constant was higher than 1.0. Accordingly, it is considered that these defects result in intermixing of the iron contents at the bottom portion of the electrolytic cell in the produced aluminum. Furthermore, when a carbon cathode having a stability constant of less than 0.7 was used, the formation of aluminum carbide was markedly observed on the carbon cathode as compared with the case of using conventional carbon cathodes. Consequently, it is considered that the formation of aluminum carbide causes an increase in the electric resistance of the cathode and the extraordinary current distribution.

In addition, it is desirable that the graphitized carbon cathode of this invention contain petroleum coke in an amount of more than 50% by weight of the dry aggregate for the cathode carbon block. Almost similar results are obtained when the carbon cathode of this invention contains, besides the carbon component from petroleum coke, other carbonaceous materials, such as calcined anthracite, other cokes (excluding petroleum coke), and other graphitized carbonaceous materials in an amount of less than 50% by weight of the dry aggregate for the cathode carbon block. However, if the contents of these other materials (excluding petroleum coke) become higher than 50%, the life of the electrolytic cell cannot be improved. A particularly desirable range for the content of petroleum coke in the carbon cathode of this invention is more than 70% by weight of the dry aggregate for the cathode carbon block.

A better understanding of the present invention will be obtained from the following examples which are illustrative and not limitative of the present invention.

EXAMPLE 1

To 100 parts by weight of a blend consisting of 30% by weight of petroleum coke of 5–10 mm in size, 10% by weight of petroleum coke of 2–5 mm in size, 20% by weight of petroleum coke of 1–2 mm in size, 30% by weight of petroleum coke of less than 0.1 mm in size, and 10% by weight of artificial graphite powder of less than 0.1 mm in size was added 27 parts by weight of a pitch for binder. The mixture was kneaded for 2 hours at 125° C, molded at an extrusion pressure of 30 kg/cm², baked in a baking furnace at 1000° C, and then further baked in an electric furnace at the maximum temperature of 2250° C. The various characteristics of the carbon block thus prepared were measured and then the carbon block was employed as a cathode for an aluminum electrolytic cell. The results of the experiment are shown in Table 1.

EXAMPLE 2

To 100 parts by weight of a blend consisting of 25% by weight of petroleum coke of 5–10 mm in size, 8% by weight of petroleum coke of 2–5 mm in size, 17% by weight of petroleum coke of 1–2 mm in size, 25% by weight of petroleum coke of 0.1 mm in size, 15% by weight of anthracite of less than 10 mm in size calcined at 1300° C, and 10% by weight of artificial graphite powder of less than 0.1 mm in size was added 25 parts by weight of a pitch for binder. The mixture was kneaded for 2 hours at 125° C, molded at an extrusion pressure of 30 kg/cm², baked in a baking furnace at 1000° C, and then further baked in an electric furnace at the maximum temperature of 2300° C. The various characteristics of the carbon block thus obtained were measured and then the carbon block was used as a cathode for an aluminum electrolytic cell. The results of the experiment are also shown in Table 1.

EXAMPLE 3

To 100 parts by weight of a blend consisting of 20% by weight of petroleum coke of 5–10 mm in size, 7% by weight of petroleum coke of 2–5 mm in size, 13% by weight of petroleum coke of 1–2 mm in size, 20% by weight of petroleum coke of less than 0.1 mm in size, 30% by weight of anthracite of less than 10 mm in size calcined at 1300° C, and 10% by weight of artificial graphite powder of less than 0.1 mm in size was added 22 parts by weight of a pitch. The mixture was kneaded for 2 hours at 125° C, molded at an extrusion pressure of 30 kg/cm², baked in a baking furnace at 1000° C, and then further baked in an electric furnace at the maximum temperature of 2400° C. The various characteristics of the carbon block thus prepared were measured and the carbon block was used as the cathode for an aluminum electrolytic cell. The results of the experiment are also shown in Table 1.

The characteristics of the carbon blocks prepared in the above-mentioned examples of this invention and the life of the aluminum electrolytic cell when the carbon block of this invention (prepared by each of the above examples) was used as the cathode for the electrolytic cell are shown in the following Table 1. In addition, the characteristics of commercially available carbon cathodes and the life of the aluminum electrolytic cell when such a carbon cathode was employed are also shown.

Table 1

| | (A) | (B) | (C) (%) | (D) ($10^{-5}$ ohm-cm) | (E) (kg/cm²) | (F) | (G) (years) |
|---|---|---|---|---|---|---|---|
| General standard | >1.55 | >1.90 | <20 | <500 | >300 | — | — |
| Example 1 | 1.56 | 2.18 | 28 | 115 | 269 | 0.91 | 5.5 |
| Example 2 | 1.57 | 2.15 | 27 | 128 | 243 | 0.88 | 5.4 |
| Example 3 | 1.58 | 2.13 | 26 | 194 | 208 | 0.94 | 4.9 |
| Control 1* | 1.58 | 1.93 | 18.1 | 365 | 435 | 1.10 | 4.0 |
| Control 2** | 1.57 | 1.94 | 19.1 | 531 | 332 | 1.16 | 3.9 |

(A) Apparent specific gravity
(B) True specific gravity
(C) Porosity
(D) Specific resistance
(E) Compressive strength
(F) Stability constant
(G) Life of the electrolytic cell

*Commercially available carbon cathode made by Showa Denko K. K.
**Commercially available carbon cathode made by Savoie, France.

As is clear from the above results, the use of the carbon block of this invention as the cathode for an aluminum electrolytic cell can prolong greatly the period of the continuous run of the electrolytic cell as compared with the case of using a conventional carbon cathode. Thus it will be understood that the invention provides quite a large economical effect.

Although the present invention has been adequately discussed throughout the foregoing specification and examples included therein, it is readily apparent that various changes and modifications may be made without departing from the scope and spirit thereof.

What is claimed is:

1. In an electrolytic process for producing aluminum which comprises dissolving alumina in a molten salt bath containing cryolite at an elevated temperature in an electrolytic cell and electrolyzing said alumina by passing a direct current through the molten salt bath through a carbon anode to a carbon cathode constructed by lining baked carbon blocks on the bottom of the electrolytic cell to deposit aluminum on the bottom of the electrolytic cell, the improvement which comprises prolonging the life of the electrolytic cell by constructing said cathode of at least one carbon block having a stability constant of 0.7–1.0, said block consisting of at least 50% by weight of petroleum coke and less than 50% by weight of at least one other carbonaceous material selected from the group consisting of calcined anthracite, cokes other than petroleum coke, and other graphitized carbonaceous materials, based on the weight of a dry aggregate of the coke and said other materials, which has been kneaded with pitch, formed and baked at a temperature higher than 2000° C but lower than about 2400° C to yield said carbon block.

2. The process according to claim 1 wherein the content of petroleum coke is more than 70% of the weight of the dry aggregate for the cathode carbon block.

* * * * *